US005279760A

United States Patent [19]

Sato et al.

[11] Patent Number: 5,279,760

[45] Date of Patent: Jan. 18, 1994

[54] CLEANING AGENT COMPOSITIONS USED FOR GAS TURBINE AIR COMPRESSORS

[75] Inventors: Tsuneo Sato; Akihisa Inomata; Minoru Horikawa; Yasushi Takizawa, all of Niigata; Toshinobu Imahama; Yoshiaki Shibata, both of Toda, all of Japan

[73] Assignee: Tohoku Electric Power Co., Inc., Tokyo, Japan

[21] Appl. No.: 984,451

[22] Filed: Dec. 2, 1992

[30] Foreign Application Priority Data

Dec. 20, 1991 [JP] Japan ..... 3-354279

[51] Int. Cl.[5] ..... C11D 1/72; C11D 1/68; C11D 1/70; C11D 1/83

[52] U.S. Cl. ..... 252/174.22; 252/170; 252/171; 252/173; 252/174.21; 252/546; 252/DIG. 14

[58] Field of Search ..... 252/174.22, 170, 171, 252/174.21, 546; 134/22.14, 22.19

[56] References Cited

U.S. PATENT DOCUMENTS

| | | | |
|---|---|---|---|
| 3,031,409 | 4/1962 | Perlman et al. | 134/22.19 |
| 3,694,365 | 9/1972 | Castner | 252/106 |
| 3,830,660 | 8/1974 | Ezell | 134/23 |
| 3,839,234 | 10/1974 | Roscoe | 252/544 |
| 3,882,038 | 5/1975 | Clayton et al. | 252/164 |
| 4,376,069 | 3/1983 | Maggi | 252/542 |
| 4,808,235 | 2/1989 | Woodson et al. | 134/22.19 |
| 4,834,912 | 5/1989 | Hodgens, II et al. | 252/545 |
| 4,861,518 | 8/1989 | Morganson et al. | 252/548 |
| 4,863,524 | 9/1989 | Kombashiri et al. | 134/22.19 |
| 4,904,309 | 2/1990 | Kombashiri et al. | 134/42 |
| 4,995,915 | 2/1991 | Sewell et al. | 134/22.14 |
| 5,002,078 | 3/1991 | Kaes | 134/42 |
| 5,075,040 | 12/1991 | Rivanaes | 252/548 |
| 5,076,855 | 12/1991 | Kaes | 134/2 |

FOREIGN PATENT DOCUMENTS

| | | |
|---|---|---|
| 0275987 | 7/1988 | European Pat. Off. . |
| 200470 | 5/1983 | Fed. Rep. of Germany . |
| 57-100196 | 6/1982 | Japan . |
| 63-234095 | 9/1988 | Japan . |
| 3-2777700 | 12/1991 | Japan . |
| 2104541 | 3/1983 | United Kingdom . |

OTHER PUBLICATIONS

Scheper et al., "Maintaining Gas Turbine Compressors for High Efficiency", Power Engineering, (Aug. 1978), pp. 54 to 57.

Braaten, "In-Service Cleaning of Power Unit", The Indian And Eastern Engineer, vol. 124, (Mar. 1982), pp. 111 to 113.

*Primary Examiner*—Paul Lieberman
*Assistant Examiner*—A. Hertzog
*Attorney, Agent, or Firm*—Fisher, Christen & Sabol

[57] ABSTRACT

According to the present invention there is provided a cleaning agent composition capable of removing the foulants deposited in gas turbine air compressors even during their operation and thereby cleaning the compressors.

That is, there is provided a cleaning agent composition comprising (A) a solvent component consisting of a combination of a particular monovalent aliphatic alcohol-ethylene glycol adduct and a particular phenol-ethylene glycol adduct, and (B) a surfactant component consisting of a combination of a particular polyethylene glycol mono(alkylphenol) ether and an ammonium or amine salt of a particular fatty acid. Said composition is diluted with purified water and used for cleaning of gas turbine air compressors, particular their turbine blades.

The cleaning agent composition has high cleaning power; the gas turbine unit of the compressor cleaned with the composition is not liable to undergo secondary fouling or adverse effect because the composition scarcely remains thereon after cleaning; and the composition further has a rust-preventive effect for the compressor.

5 Claims, No Drawings

CLEANING AGENT COMPOSITIONS USED FOR GAS TURBINE AIR COMPRESSORS

BACKGROUND OF THE INVENTION

1.) Field of the Invention

The present invention relates to cleaning agent compositions used for gas turbine air compressors. (The cleaning agent compositions of the present invention are applied mainly to the turbine blades of gas turbine air compressor and possibly even to the members contiguous thereto. More particularly, the present invention relates to cleaning agent compositions suitable for the effective removal of the foulants deposited in gas turbine air compressors and the cleaning of the compressors.

2.) Description of the Related Art

The turbine blades installed in a gas turbine air compressor are rotated at a high speed. As a result, contaminants present in the air adhere onto the surfaces of a large number of such turbine blades in a considerable amount. When the contaminants or foulants deposited on the blades are left unremoved, the operational efficiency of the gas turbine air compressor is reduced remarkably. To avoid the inconvenience, it is necessary to periodically clean the surfaces of turbine blades of the gas turbine air compressor to constantly keep the surfaces in a clean state.

The methods for cleaning gas turbine air compressor are described in, for example, "Maintaining Gas Turbine Compressors for High Efficiency" by Scheper et al. [Power Engineering, August 1978, pp. 54–57]and "In-service Cleaning of Powder Units" by Braaten [The Indian and Eastern Engineer, Vol. 124, March 1982, pp. 111–113]. In these pieces of literature, there are described aqueous surfactant solutions as cleaning agents.

Also, in UK Patent Application Laid-Open No. 2,104,541, there is disclosed a cleaning agent composition used for gas turbine engines. In this cleaning agent composition, there are used ethylene glycol monoethyl ether, ethylene glycol monobutyl ether or the like as the solvent component; sodium dioctylsulfosuccinate or the like as the surfactant component; and a corrosion inhibitor. The pH of the aqueous solution of this cleaning agent composition is controlled at 8–12.

Further in Japanese Patent Application Laid-Open No. 234095/1988, there is disclosed a cleaning agent composition used for gas turbine air compressors. In this cleaning agent composition, there are used, as the solvent component, a compound obtained by adding 1–5 moles of ethylene oxide or propylene oxide to an aliphatic alcohol of 1–4 carbon atoms, such as diethylene glycol monomethyl ether, triethylene glycol monomethyl ether, diethylene glycol monoethyl ether, ethylene glycol monobutyl ether, diethylene glycol monobutyl ether, propylene glycol monomethyl ether or the like; and, as the surfactant component, nonylphenyl ethoxylate, an ethylene oxide adduct of a higher alcohol or fatty acid, and a polyoxyethylene coconut oil amine.

In cleaning gas turbine air compressors using any of the above cleaning agent compositions of prior art, however, there are various problems. That is, their cleaning powers are insufficient; the compositions remain partially on the turbine blades of compressor after cleaning, which tends to invite the secondary fouling of the turbine blades; and such residual cleaning agent gives adverse effects on the materials of gas turbine unit.

Therefore, the cleaning of gas turbine air compressor is currently conducted generally by stopping the operation of the gas turbine unit, disintegrating 100–200 turbine blades to take out each blade one by one and clean the respective blades by a physical method. (Thorough cleaning of the turbine unit without disintegrating it is virtually impossible.)

The cost incurred for the above cleaning operation and the compensation for the long period of operational suspension are enormous. Hence, the reduction of such cost or compensation is an urgent and most important task for economy improvement in, for example, electric power plants using gas turbines.

SUMMARY OF THE INVENTION

The present invention is intended to solve the above-mentioned problems and has an object of providing cleaning agent compositions suitable for removal of the foulants deposited on the turbine blades, etc. of gas turbine air compressors.

The present invention relates to cleaning agent compositions capable of removing the foulants deposited on gas turbine air compressors, even during their operation and thereby cleaning the compressors.

That is, the present invention relates to cleaning agent compositions comprising (A) a solvent component consisting of a combination of a particular monovalent aliphatic alcohol-ethylene glycol adduct and a particular phenol-ethylene glycol adduct and (B) a surfactant component consisting of a combination of a particular polyethylene glycol mono(alkylphenol) ether and an ammonium or amine salt of a particular fatty acid. Said composition is diluted with purified water and used for cleaning of gas turbine air compressors, particularly their turbine blades.

The cleaning agent compositions have high cleaning power; the gas turbine units of the compressors cleaned with the compositions undergo substantially no adverse effect (e.g. liability to secondary fouling and corrosion) because the compositions scarcely remain in the compressors after cleaning; the compositions further have a corrosion-inhibiting effect for the compressors.

DETAILED DESCRIPTION OF THE INVENTION

The present inventors made an extensive research and found that the above-mentioned problems of the prior art can be solved by cleaning agent compositions shown below. The finding has led to the completion of the present invention.

According to the present invention there are provided cleaning agent compositions used for gas turbine air compressors, which comprise 1–100 parts by weight of the following solvent component (A) and 1–100 parts by weight of the following surfactant component (B):

(A) a solvent component consisting of a combination of a compound of the following general formula (1) and a compound of the following general formula (2):

$$R_1O(C_2H_4O)_mH \quad (1)$$

($R_1$ represents an aliphatic hydrocarbon group of 1–5 carbon atoms and m represents an integer of 1–5), $$R_2\text{—[benzene ring]—}O(C_2H_4O)_nH \quad (2)$$

($R_2$ represents a hydrogen atom, a methyl group or an ethyl group and n represents an integer of 1–10), and (B) a surfactant component consisting of a combination of a compound of the following general formula (3) and a compound of the following general formula (4):

$$R_3\text{—[benzene ring]—O}(C_2H_4O)_kH \quad (3)$$

($R_3$ represents an aliphatic hydrocarbon group of 5–20 carbon atoms and k represents an integer of 4–30), $$R_4COOH\cdot X \text{ (salt)} \quad (4)$$

($R_4$ represents an aliphatic hydrocarbon group of 4–23 carbon atoms and X represents ammonia or an amine compound).

Prior to the development of the above cleaning agent compositions used for gas turbine air compressors, the present inventors conducted the analysis of the foulants deposited on the turbine blades of gas turbine air compressors. It revealed that the foulants contain not only organic substances but also a considerable amount of inorganic substances, as shown in Table 1.

TABLE 1

Analysis of foulants deposited on turbine blades

| Components of foulants | Content (wt. %) |
|---|---|
| Inorganic components | |
| Sulfur | 4.06 |
| Chlorine | 2.86 |
| Iron | 10.9 |
| Potassium | 1.21 |
| Silicon | 1.21 |
| Organic components | |
| Ignition loss at 450° C. | 76.1 |
| Ignition loss at 900° C. | 80.8 |

It is clear from Table 1 that the foulants consist of a mixture of hydrophilic substances and oleophilic substances.

In view of the above fact, the present inventors made an extensive study in order to develop cleaning agent compositions containing a combination of a solvent component and a surfactant component, which combination is optimum for the cleaning of the hydrophilic substances and oleophilic substances present in the foulants. As a result, the present inventors succeeded in development of the above-mentioned unique cleaning agent compositions of the present invention for gas turbine air compressors, having superb cleaning power for the foulants deposited on the turbine blades of the compressors. It seems that proper consideration was not paid to the balance of hydrophilicity and oleophilicity of the foulants in developing the cleaning agent compositions as disclosed in the afore-mentioned prior art literature.

The present invention is hereinafter described in detail.

The cleaning agent compositions used for gas turbine air compressors according to the present invention may have an anhydrous form in consideration of the convenience in transportation, etc., but preferably has an aqueous solution form containing 30–99% by weight of water in consideration of the convenience in actual use, etc.

The solvent component (A) used in the present cleaning agent compositions for gas turbine air compressors, is characterized by consisting of a combination of a compound of general formula (1) having excellent solvency for hydrophilic substances and a compound of general formula (2) having excellent solvency for oleophilic substances. Hence, the solvent component (A) has excellent solvency for both of the hydrophilic substances and oleophilic substances contained in the foulants deposited on the turbine blades of gas turbine air compressors.

Therefore, one of the constituents of the solvent component (A) is at least one compound or a mixture of more than one compound represented by general formula (1) and has excellent solvency for the hydrophilic substances of the foulants deposited on the turbine blades.

In general formula (1), the number of the carbon atom(s) of $R_1$ (an aliphatic hydrocarbon group) is in the range of 1–5. When the number of the carbon atoms is larger than 5, the solvent compound has low water solubility. Also in general formula (1), m (the number of ethylene oxide units) is an integer of 1–5. When m is larger than 5, the solvent compound has high water solubility but has low solvency for the hydrophilic substances of the foulants. Consequently, the number of the carbon atoms of $R_1$ and m of the solvent compound of general formula (1) should preferably be 1–4 and 1–3, respectively.

The compound of general formula (1) can be exemplified by ethylene glycol monomethyl ether, ethylene glycol monoethyl ether, ethylene glycol monopropyl ether, ethylene glycol monobutyl ether, diethylene glycol monomethyl ether, diethylene glycol monoethyl ether, diethylene glycol monopropyl ether, diethylene glycol monobutyl ether, triethylene glycol monomethyl ether, triethylene glycol. monoethyl ether, triethylene glycol monopropyl ether, triethylene glycol monobutyl ether and triethylene glycol monopentyl ether.

The other constituent of the solvent component (A) is at least one compound or a mixture of more than one compound represented by general formula (2) and has excellent solvency for the oleophilic substances of the foulants deposited on the turbine blades.

In general formula (2), $R_2$ represents a hydrogen atom, a methyl group or an ethyl group. When $R_2$ is an aliphatic hydrocarbon group of 3 or more carbon atoms, the solvent compound has low solubility in water. Also in general formula (2), n (the number of ethylene oxide units) is an integer of 1–10. When n is larger than 10, the solvent compound has high solubility in water but has low solvency for the oleophilic substances of the foulants. Consequently, the number of the carbon atoms of the $R_2$ and n of the solvent compound of general formula (2) should preferably be one and 1–8, respectively.

The compound of general formula (2) can be exemplified by ethylene glycol monophenyl ether, diethylene glycol monophenyl ether, triethylene glycol monophenyl ether, tetraethylene glycol monophenyl ether, pentaethylene glycol monophenyl ether, hexaethylene glycol monophenyl ether, heptaethylene glycol monophenyl ether and octaethylene glycol monophenyl ether.

Thus, the solvent component (A) of the present cleaning agent compositions, which is a combination of solvent compound(s) having excellent solvency for the hydrophilic substances of the foulants and solvent compound(s) having excellent solvency for the oleophilic substances of the foulants, has excellent solvency for all the substances of the foulants.

Use of the solvent compound(s) of general formula (1) and the solvent compound(s) of general formula (2) in combination is a characteristic of the present invention. The weight ratio of the compound(s) (1) and the compound(s) (2) used is preferably 0.9/0.1 to 0.1/0.9, more preferably 0.8/0.2 to 0.2/0.8.

The surfactant component (B) used in the present cleaning agent composition is characterized by consisting of a combination of compound(s) of general formula (3) having excellent dispersancy and emulsibility for the oleophilic substances deposited on the turbine blades of gas turbine air compressors and compound(s) of general formula (4) having excellent dispersancy and emulsibility for the hydrophilic substances. Hence, the surfactant component (B) has excellent dispersancy and emulsibility for both of the oleophilic substances and hydrophilic substances contained in the foulants deposited on the turbine blades of gas turbine air compressors.

Therefore, one of the constituents of the surfactant component (B) is at least one compound or a combination of more than one compound represented by general formula (3), and has excellent dispersancy and emulsibility for the oleophilic substances of the foulants and further promotes the penetration of the present cleaning agent composition into the foulants.

In general formula (3), the number of the carbon atoms of $R_3$ (an aliphatic hydrocarbon group) is in the range of 5-20. When the number of the carbon atoms is smaller than 5, the surfactant compound has low surface activity. When the number of the carbon atoms is larger than 20, the surfactant compound has low solubility in water and accordingly has low dispersancy and emulsibility. Also in general formula (3), k (the number of ethylene oxide units) is an integer of 4-30. When k is smaller than 4, the surfactant compound has low water solubility. When k is larger than 30, the surfactant compound has high water solubility, but has low penetrability into the foulants and low dispersancy and emulsibility for the foulants. Consequently, the number of the carbon atoms of $R_3$ and k of the surfactant compound of general formula (3) should preferably be 5-10 and 4-15, respectively.

The compound of general formula (3) can be exemplified by polyethylene glycol mono(pentylphenol) ether, polyethylene glycol mono(hexylphenol) ether, polyethylene glycol mono(heptylphenol) ether, polyethylene glycol mono(octylphenol) ether, polyethylene glycol mono(nonylphenol) ether, polyethylene glycol mono(-decylphenol) ether and polyethylene glycol mono(-dodecylphenol) ether. The ethylene oxide unit number of the polyethylene glycol portion of each of the above compounds should preferably be 4-20, more preferably 4-15.

The other constituent of the surfactant component (B) of the present cleaning agent composition is at least one compound or a mixture of more than one compound represented by general formula (4). It has excellent dispersancy and emulsibility for the hydrophilic substances of the foulants, prevents the readhesion of foulants onto gas turbine air compressors, and has excellent solvency for metal ions.

In general formula (4), the number of the carbon atoms of $R_4$ (an aliphatic hydrocarbon group) is in the range of 4-23. When the number of the carbon atoms is smaller than 4, the surfactant compound has high water solubility but has low surface activity. When the number of the carbon atoms is larger than 23, the surfactant compound has low water solubility and accordingly has low surface activity. Consequently, the number of the carbon atoms of $R_4$ of the surfactant compound of general formula (4) is particularly preferably 5-21.

The carboxylic acid represented by $R_4COOH$ in general formula (4) can be exemplified by pentanoic acid, hexanoic acid, heptanoic acid, octanoic acid, nonanoic acid, decanoic acid, lauric acid, myristic acid, palmitic acid, oleic acid, stearic acid, erucic acid and behenic acid.

Also in general formula (4), X is ammonia for forming an ammonium salt of a carboxylic acid, or an amine compound for forming an amine salt of a carboxylic acid. The amine compound can be exemplified by alkanolamines, morpholine, ethylenediamine, polyalkylenepolyamines and primary, secondary or tertiary amines. The number of the carbon atoms of the alkyl group should preferably be 1-8. Of these amine compounds, alkanolamines are particularly preferable.

The compound of general formula (4), which is an ammonium salt or an amine salt each of a carboxylic acid, also has a corrosion-inhibiting activity. Consequently, the present cleaning agent composition containing the compound (4) has also a rust-preventive effect for various metal materials of gas turbine plants and the like during their cleaning.

The surfactant component (B), which is a combination of the compound of general formula (3) and the compound of general formula (4), has excellent dispersancy and emulsibility for both of the oleophilic substances and hydrophilic substances of the foulants deposited in gas turbine air compressors. Such use of the compound of general formula (3) and the compound of general formula (4) in combination is another characteristic of the present invention.

The weight ratio of the compound of general formula (3) and the compound of general formula (4) used is preferably 0.9/0.1 to 0.1/0.9, more preferably 0.7/0.3 to 0.3/0.7.

The water used for preparation of an aqueous solution of the present cleaning agent composition is preferably purified water which is substantially free from metallic ions, inorganic substances, organic substances, etc. in order to prevent the corrosion of gas turbine air compressor or the prevention of scale formation thereon. Such purified water includes deionized water, distilled water, steam condensate, or their mixtures.

The cleaning agent composition for gas turbine air compressors according to the present invention comprises the solvent component (A) and the surfactant component (B) as essential components. The composition may further comprise, as necessary, at least one of additives such as water-soluble corrosion inhibitor, pH-adjusting agent, stabilizer and the like.

The solvent component (A) of the present cleaning agent compositions for gas turbine air compressors consists of a combination of compound(s) of general formula (1) having excellent solvency for hydrophilic substances and a compound of general formula (2) having excellent solvency for oleophilic substances. Therefore, the present cleaning agent composition has excellent solvency for both of the hydrophilic substances and oleophilic substances contained in the foulants deposited in gas turbine air compressors, particularly on the turbine blades.

The surfactant component (B) of the present cleaning agent compositions for gas turbine air compressors consists of a combination of compound(s) of general formula (3) having excellent dispersancy and emulsibility for oleophilic substances dispersancy and emulsibility for hydrophilic substances. Therefore, the present cleaning agent composition has excellent dispersancy and emulsibility for both of the oleophilic substances and hydrophilic substances contained in said foulants.

The present cleaning agent composition, containing the compound(s) of general formula (4), also has a corrosion-inhibiting effect. Further, the present cleaning agent composition scarcely remains on the materials (turbine blades, etc.) cleaned therewith and can minimize the secondary fouling of said materials or the adverse effects on the cleaned gas turbine unit, etc.

EXAMPLES

The present invention is hereinafter described in more detail by way of Examples. However, the present invention is by no means restricted by the Examples.

First, the specific formulations and properties of the cleaning agent compositions in accordance with the present invention are shown in Table 2. The specific formulations and properties of comparative cleaning agents are shown in Table 3. In Table 2 and Table 3, the materials used in the formulations are expressed by the following abbreviations and their weights are indicated by weight %.

EGMBE: ethylene glycol monobutyl ether
EGMEE: ethylene glycol monoethyl ether
DEGMPE: diethylene glycol monopropyl ether
DEGMME: diethylene glycol monomethyl ether
TEGMBE: triethylene glycol monobutyl ether
TEGMPE: triethylene glycol monophenyl ether
TTEGMPE: tetraethylene glycol monophenyl ether
HEGMPE: hexaethylene glycol monophenyl ether
OEGMPE: octaethylene glycol monophenyl ether
TTEGMMPE: tetraethylene glycol mono(methylphenol) ether
PEGMPPE: polyethylene glycol mono(pentylphenol) ether (average number of ethylene oxide units: 6)
PEGMHPE: polyethylene glycol mono(heptylphenol) ether (average number of ethylene oxide units: 8)
PEGMNPE: polyethylene glycol mono(nonylphenol) ether (average number of ethylene oxide units: 10)
PEGMDPE: polyethylene glycol mono(dodecylphenol) ether (average number of ethylene oxide units: 12)
PEGMHXPE: polyethylene glycol mono(hexylphenol) ether (average number of ethylene oxide units: 14)
PA-TEA: pentanoic acid-triethanolamine salt
NA-MEA: nonanoic acid-monoethanolamine salt
LA-MPL: lauric acid-morpholine salt
SA-A: stearic acid-ammonia salt
EA-DEA: erucic acid-diethanolamine salt

TABLE 2

| | Cleaning agent compositions of Examples | | | | | | | | |
|---|---|---|---|---|---|---|---|---|---|
| | Example | | | | | | | | |
| Materials | No. 1 | No. 2 | No. 3 | No. 4 | No. 5 | No. 6 | No. 7 | No. 8 | No. 9 |
| Solvent component (A) | | | | | | | | | |
| General formula (1) | | | | | | | | | |
| EGMBE | | 9.0 | 5.1 | | 7.4 | 7.5 | | | 2.0 |
| EGMEE | 8.0 | | | | | | 3.6 | | |
| DEGMPE | | | 4.3 | | | | | | 9.0 |
| DEGMME | | | | 10.5 | | | 5.0 | | |
| TEGMBE | | | | | | 2.3 | | 2.0 | |
| General formula (2) | | | | | | | | | |
| TEGMPE | | 0.6 | 2.6 | | 1.1 | | | | |
| TTEGMPE | 3.0 | 1.2 | | | 1.0 | 2.0 | | | |
| HEGMPE | | 1.0 | | | 0.7 | 1.3 | | | 1.5 |
| OEGMPE | | 0.3 | | | | | 1.0 | | |
| TTEGMMPE | | | | 3.6 | | | | 9.4 | |
| Surfactant component (B) | | | | | | | | | |
| General formula (3) | | | | | | | | | |
| PEGMPPE | | | 8.7 | | | | | | |
| PEGMHPE | | | | 4.7 | | | | | |
| PEGMNPE | | 9.3 | | 4.7 | 9.2 | | 9.8 | 3.8 | 5.1 |
| PEGMDPE | | | | | | | | | 2.1 |
| PEGMHXPE | 10 | | | | | 12 | | | |
| General formula (4) | | | | | | | | | |
| PA-TEA | | 12.0 | | 5.0 | | | | 1.2 | 2.5 |
| NA-MEA | | | | | 11.7 | | | 1.2 | 2.5 |
| LA-MPL | | | | 6.8 | | | 1.7 | 6.6 | |
| SA-A | 8.5 | | 9.4 | | | | | | |
| EA-DEA | | | | | | 10.6 | | 4.5 | |
| Deionized water | 70.5 | 66.6 | 69.9 | 64.7 | 68.9 | 64.3 | 78.9 | 71.3 | 75.3 |
| Properties | | | | | | | | | |
| Appearance | Transparent liquid | Transparent liquid | Transparent liquid | Transparent liquid | Transparent liquid | Transparent liquid | Transparent liquid | Transparent liquid | Transparent liquid |
| pH (20° C.) | 7.1 | 7.5 | 7.4 | 7.6 | 7.6 | 7.4 | 7.2 | 7.8 | 7.3 |
| Cloud point (°C.) | 94 | 65 | 85 | 67 | 73 | 79 | 80 | 75 | 74 |

TABLE 3

| | Cleaning agents of Comparative Examples | | |
|---|---|---|---|
| | Comparative Example | | |
| Materials | No. 11 | No. 12 | No. 13 |
| Solvent component (A) | | | |
| General formula (1) | | | |
| EGMBE | | 8.3 | 4.0 |
| EGMEE | 10.5 | | |
| DEGMPE | | | 7.8 |
| General formula (2) | | | |

TABLE 3-continued

| Cleaning agents of Comparative Examples | | | |
|---|---|---|---|
| | Comparative Example | | |
| Materials | No. 11 | No. 12 | No. 13 |
| TEGMPE | | 1.5 | |
| TTEGMPE | | 1.2 | |
| Surfactant component (B) | | | |
| General formula (3) | | | |
| PEGMPPE | | | 5.5 |
| PEGMHPE | | 9.3 | |
| PEGMNPE | 8.5 | | 6.3 |
| General formula (4) | | | |
| NA-MEA | 7.8 | | |
| Deionized water | 73.2 | 79.4 | 76.4 |
| Properties | | | |
| Appearance | Transparent liquid | Transparent liquid | Transparent liquid |
| pH (20° C.) | 7.6 | 7.2 | 7.4 |
| Cloud point (°C.) | 77 | 79 | 83 |

Cleaning test

Using cleaning agent compositions of the present invention and comparative cleaning agents, cleaning tests were conducted for the turbine blades taken out from the same main shaft and stage of an actual gas turbine air compressor. The results are shown in Table 4.

In Table 4, the cleaning effect of each cleaning agent was measured by visually observing the amount of foulants remaining on the turbine blades after cleaning. The cleaning effect of the cleaning agent which gave the highest cleaning power, was taken as 100, and the cleaning effect of any other cleaning agent was expressed as a relative value to 100, obtained by visual comparison.

TABLE 4

| Cleaning test | | | |
|---|---|---|---|
| Cleaning agent | Conc. (wt. %) | Temp. (°C.) | Cleaning effect (Front side/ Back side) |
| Example | | | |
| No. 1 | 20 | 60 | 80/90 |
| No. 2 | 20 | 60 | 95/95 |
| No. 5 | 20 | 60 | 100/100 |
| No. 8 | 20 | 60 | 85/100 |
| Comparative Example | | | |
| No. 11 | 20 | 60 | 40/60 |
| No. 12 | 20 | 60 | 50/70 |
| No. 13 | 20 | 60 | 30/30 |
| Reference Example Deionized water | — | 60 | 10/10 |

The above cleaning tests were conducted as follows.

Each cleaning agent was diluted with deionized water and made into an aqueous solution containing 20% by weight of the cleaning agent. The diluted cleaning agent or deionized water was heated to 60° C. and used for cleaning. The procedure of cleaning was as follows.

Spraying of cleaning agent solution (500 ml for 2 minutes) → standing for 30 minutes → spraying of deionized water (500 ml for 2 minutes) → standing for 30 minutes → spraying of deionized water (500 ml for 2 minutes) → evaluation of cleaning effect by visual observation Corrosion test Using cleaning agent compositions of the present invention and comparative cleaning agents, corrosion tests were conducted for various member materials of gas turbine compressors, etc. used at an electric power plant. The results are shown in Table 5. In Table 5, each of the individual numerical values represents a corrosion rate which is explained later.

TABLE 5

| Corrosion test | | | | | | | | |
|---|---|---|---|---|---|---|---|---|
| | Example | | | | Comparative Example | | | Reference Example |
| Test piece | No. 1 | No. 2 | No. 5 | No. 8 | No. 11 | No. 12 | No. 13 | Tap water |
| Compressor casing material | 0.24 | 0.08 | 0.35 | 0.15 | 0.23 | 0.89 | 1.02 | 381.47 |
| Boiler duct material | 0.15 | 0.32 | 0.08 | 0.28 | 0.47 | 1.24 | 0.90 | 343.28 |
| Burner material | 0.32 | 0.16 | 0.00 | 0.08 | 0.28 | 0.31 | 0.64 | 0.89 |
| Compressor moving blade material | 0.01 | 0.08 | 0.39 | 0.04 | 0.11 | 0.06 | 0.20 | 0.22 |
| Compressor stationary blade material | 0.03 | 0.00 | 0.00 | 0.01 | 0.01 | 0.02 | 0.78 | 0.17 |
| Coating material for compressor moving/stationary blades | 0.03 | 0.00 | 0.00 | 0.02 | 0.02 | 0.64 | 0.51 | 0.00 |
| First-stage stationary blade material | 0.17 | 0.31 | 0.08 | 0.23 | 0.38 | 0.54 | 0.80 | 0.42 |
| Second-stage gas exhaust pipe material | 0.32 | 0.41 | 0.23 | 0.18 | 0.39 | 1.92 | 1.09 | 412.63 |

The above corrosion tests were conducted as follows.

Each test piece (50 mm×40 mm×4 mm) was immersed in 1 liter of an aqueous solution containing 20% by weight of a cleaning agent, at 60° C. (the same temperature as employed in the above cleaning tests) for 1 week, with stirring at 150 rpm. The weight decrease of the test piece during the immersion was measured and the corrosion rate of the test piece was calculated as follows using the weight decrease.

$$\text{Corrosion rate} = [W_o - W]/[A \times D](\text{mg/dm}^2\cdot\text{day})$$

where $W_o$: weight of test piece before corrosion test (mg)

W: weight of test piece after corrosion test (mg)

A: surface area of test piece ($dm^2$)

D: test period (days)

The solvent component (A) of the present cleaning agent composition for gas turbine air compressors consists of a combination of two or more solvent compounds and has excellent solvency for both of the hydrophilic substances and oleophilic substances contained in the foulants deposited in gas turbine air compressors, particularly on their turbine blades.

The surfactant component (B) of the present cleaning agent composition for gas turbine air compressors consists of a combination of two or more surfactant compounds and has excellent dispersancy and emulsibility for both of the hydrophilic substances and oleophilic substances contained in said foulants.

Thus, the cleaning agent composition of the present invention has excellent cleaning power for any foulants deposited in gas turbine air compressors. This makes it possible to clean a gas turbine air compressor even during its operation, without stopping the operation.

Further, the present cleaning agent composition, containing compound(s) of general formula (4), i.e. an ammonium salt or amine salt of a carboxylic acid, has a rust-preventive effect. Furthermore, the present cleaning agent composition scarcely remains on the turbine blades, etc. after cleaning and can minimize the secondary fouling of or adverse effects on the gas turbine unit after cleaning.

What is claimed is:

1. A cleaning agent composition used for gas turbine air compressors, which comprises 30 to 60 parts by weight of solvent component (A) and 30 to 60 parts by weight of surfactant component (B):

(A) a solvent component consisting of a combination of a compound or compounds of general formula (I) and a compound or compounds of general formula (2):

$$R_1O(C_2H_4O)_mH \quad (1)$$

wherein $R_1$ represents an aliphatic hydrocarbon group of 1 to 5 carbon atoms, and m represents an integer of 1 to 5, $$R_2\text{—[benzene ring]—}O(C_2H_4O)_nH \quad (2)$$

wherein $R_2$ represents a hydrogen atom, a methyl group or an ethyl group, and n represents an integer of 1 to 10, the weight ratio of the compound(s) of general formula (1) and the compound(s) of general formula (2) being in the range of 0.9/0.1 to 0.1/0.9, and (B) a surfactant component consisting of a combination of a compound or compounds of general formula (3) and a compound or compounds of general formula (4):

$$R_3\text{—[benzene ring]—}O(C_2H_4O)_kH \quad (3)$$

wherein $R_3$ represents an aliphatic hydrocarbon group of 5 to 20 carbon atoms, and k represents an integer of 4 to 30, $$R_4COOH \times X \text{ (salt)} \quad (4)$$

wherein $R_4$ represents an aliphatic hydrocarbon group of 4 to 23 carbon atoms, and X represents ammonia or an amine compound, the weight ratio of the compound(s) of general formula (3) and the compound(s) of general formula (4) being in the range of 0.9/0.1 to 0.1/0.9.

2. A cleaning agent composition according to claim 1, which further comprises water in an amount of 30–99% by weight based on the total weight of the composition.

3. A cleaning agent composition according to claim 2, wherein in the solvent component (A), the weight ratio of the compound(s) of general formula (1) and the compound(s) of general formula (2) is in the range of 0.8/0.2 to 0.2/0.8.

4. A cleaning agent composition according to claim 2, wherein in the surfactant component (B), the weight ratio of the compound(s) of general formula (3) and the compound(s) of general formula (4) is in the range of 0.7/0.3 to 0.3/0.7.

5. A cleaning agent composition according to any of claims 1,2,3 or 4, wherein the compound of general formula (1) is at least one compound selected from the group consisting of ethylene glycol monomethyl ether, ethylene glycol monoethyl ether, ethylene glycol monopropyl ether, ethylene glycol monobutyl ether, diethylene glycol monomethyl ether, diethylene glycol monoethyl ether, diethylene glycol monopropyl ether, diethylene glycol monobutyl ether, triethylene glycol monomethyl ether, triethylene glycol monoethyl ether, triethylene glycol monopropyl ether, triethylene glycol monobutyl ether and triethylene glycol monopentyl ether; the compound of general formula (2) is at least one compound selected from the group consisting of ethylene glycol monophenyl ether, diethylene glycol monophenyl ether, triethylene glycol monophenyl ether, tetraethylene glycol monophenyl ether, pentaethylene glycol monophenyl ether, hexaethylene glycol monophenyl ether, heptaethylene glycol monophenyl ether and octaethylene glycol monophenyl ether; the compound of general formula (3) is at least one compound selected form the group consisting of polyethylene glycol mono(pentylphenol) ether, polyethylene glycol mono(hexylphenol) ether, polyethylene glycol mono(heptylphenol) ether, polyethylene glycol mono(octylphenol) ether, polyethylene glycol mono(nonylphenol) ether, polyethylene glycol mono(decylphenol) ether and polyethylene glycol mono(dodecylphenol) ether (the number K of ethylene oxide units of the polyethylene glycol portion is 4-20); and the compound of general formula (4) is at least one alkanolamine salt of at least one fatty acid selected from the group consisting of pentanoic acid, hexanoic acid, heptanoic acid, octanoic acid, nonanoic acid, decanoic acid, lauric acid, myristic acid, palmitic acid, oleic acid, stearic acid, erucic acid and behenic acid.

* * * * *